US006272773B1

(12) United States Patent
Sjösvärd

(10) Patent No.: US 6,272,773 B1
(45) Date of Patent: Aug. 14, 2001

(54) RIDING SHOE

(75) Inventor: Bertil Sjösvärd, Vallda (SE)

(73) Assignee: Mountain Horse Intl. AB, Vallda (SE)

( * ) Notice: Subject to any disclaimer, the term of this patent is extended or adjusted under 35 U.S.C. 154(b) by 0 days.

(21) Appl. No.: 09/435,990

(22) Filed: Nov. 8, 1999

(51) Int. Cl.[7] ..... A43B 5/00

(52) U.S. Cl. ..... 36/131; 36/91; 36/59 R; 36/50.1

(58) Field of Search ..... 36/131, 91, 59 R, 36/59 C, 50.1, 27, 28

(56) References Cited

U.S. PATENT DOCUMENTS 2,048,683 * 7/1936 Brockman .
2,139,263 * 12/1938 Fay .
2,162,912 * 6/1939 Craver .
2,179,942 * 11/1939 Lyne .
2,420,239 * 5/1947 Hack .
2,444,428 * 7/1948 Carrier .
2,680,310 * 6/1954 Laird et al. .
3,059,352 * 10/1962 Clason .
4,217,706 * 8/1980 Vartanian .
4,335,529 * 6/1982 Badalamenti .
4,610,099 * 9/1986 Signori .
4,879,821 * 11/1989 Graham et al. .
5,195,256 * 3/1993 Kim .
5,845,420 * 12/1998 Buccianti et al. .

* cited by examiner

*Primary Examiner*—Ted Kavanaugh
(74) *Attorney, Agent, or Firm*—Burns, Doane, Swecker & Mathis, L.L.P.

(57) ABSTRACT

A riding shoe comprising a sole, a heel and an upper defining a foot-receiving portion and an ankle-receiving portion has a pronation support system comprising an arch support integrated with the sole. This results in a shoe being comfortable when walking as well as horse riding.

19 Claims, 12 Drawing Sheets

RIDING SHOE

BACKGROUND OF THE INVENTION

This invention relates to a riding shoe for use by horse riders. Riding shoes, boots and related articles currently on the market are developed with the sole interest to provide a shoe or boot with excellent characteristics for horse riding. However, these shoes are not comfortable when walking, which is a major drawback due to the fact that a major part of caring for a horse actually involves this mode of transportation. If spending long hours in the stable, the rider therefor often have to change shoes from a pair of riding boots to a pair of more comfortable shoes in order to avoid chafed feet. On the other hand, very special demands is to be met by a proper shoe to be useful when horse riding. The present invention provides a riding shoe with excellent walking and wearing characteristics, while also exhibiting highly desirable properties for horse riding, such as safety and usability.

SUMMARY OF THE INVENTION

In accordance with the invention, a riding shoe having a sole has a pronation support system, comprising an arch support integrated with said sole. The pronation support system provides a comfortable and supportive shoe for walking as well as riding. The result is a practical shoe that may be worn for long hours while horse riding, working in the stable or simple going for a walk.

Further, the pronation support system may include a reinforced heel section of the upper, a toe-cap or a cup-shaped heel section integrated with the sole, for supporting the foot in a proper position in the shoe, which further improves the comfort and support given by the shoe. The upper of the riding shoe may exhibit lengthwise openings being held together with lacings or zip-fasteners. Preferably a shoe is provided with one opening with lacing and one opening with a zip-fastener. Consequently, the shoe may be adapted to a perfect fit with the lacing, but still being easily removed from the foot by using the zip-fastener. Further, the sole may include a treading part having a pattern of indentations and/or protrusions, at least partly extending in a direction from the inner side of the sole, backwards towards the outer side or the sole. This pattern may be in the direction of the stirrup tread in order to provide an excellent contact between the shoe and the tread while riding. Preferably, the sole is provided with a stopping edge, between a treading part and a middle part of the sole, on the side of the sole facing the ground when walking, for preventing a stirrup tread to slide back to the middle part of the sole while horse riding. This device prevents the stirrup from sliding back to said middle part of the sole, in what position the shoe, and in consequence the rider, is likely to get stuck in the stirrup if the rider falls of the horse, causing the rider to be dragged after the horse. The shoe might further be provided with a stirrup stopping device, on the outer side of the sole. The stirrup stopping device also prevents the stirrup from sliding back, as described above, and further makes it easier for the rider to get his foot into a proper position in the stirrup. This stirrup stopping device might be an integrated part of the sole, extending upwards in relation to the sole into the area of the upper, forming an abutment for the stirrup. The stirrup stopping device might also be provided as one or more tracks, extending from the lower side of the sole, in a forward direction to the upper part of the sole. When riding, using the new type of flexible stirrups giving the foot a "heel down" position, these tracks is to be aligned with the outer stirrup bone, providing an abutment therefor. The total height of the shoe is preferably 10–20 inches, providing the ankle with a steady support, still keeping the shoe relatively small. Further, the shoe may be provided with a detachable, exchangeable innersole being molded to fit the upper side of the outer sole, said innersole preferably exhibiting an intermediate layer in the treading part and the heel part of said inner sole, said layer providing high friction abutment on the upper side of the outer sole as well as shock absorption.

According to an alternative, the invention provides a riding shoe comprising a sole, a heel and an upper defining a foot-receiving portion and an ankle-receiving portion. A stirrup stopping device is provided on the outer side of the sole, said stopping device comprising at least two tracks extending from the lower side of the sole, in a forward direction to the upper part of the sole. When riding, using the new type of flexible stirrups giving the foot a "heel down" position, these tracks is to be parallel with the outer stirrup bone, providing an abutment therefor. The shoe may further include a sole extension being provided in integration with the sole, above said tracks, said extension forming an abutment for the stirrup. To further keep the stirrup in the wanted position, the shoe may include a stopping edge on the ground facing side of the sole, between a treading part and a middle part, preventing the stirrup thread from sliding back to the middle part, in what position the shoe, and in consequence the rider, is likely to get stuck in the stirrup if the rider falls of the horse, causing the rider to be dragged after the horse. Preferably, the sole, comprising a treading part, a middle part and a heel part, exhibits a treading part having a striped pattern, at least partly including stripes extending in a direction from the inner side of the sole, backwards towards the outer side of the sole. The inclination of this pattern in relation to the lengthwise direction of the shoe is such that the stripes form a small or no angle to the stirrup thread in a riding position, giving a good grip between the shoe and the thread.

As stated in another alternative, the invention provides a riding shoe having a sole, a heel and an upper, defining a foot-receiving portion and an ankle-receiving portion. Said shoe has a pronation support system comprising an arch support integrated with said sole, a reinforced heel section of the upper, a cup-shaped heel section integrated with said sole, and a toe-cap for supporting the foot in its position. The upper exhibits two lengthwise openings, a first one being held together with a lacing, and a second one being held together with a zip-fastener and the shoe further have a total height of 10–20 inches. With this special combination of features a stable, supportive shoe is provided, which may be adjusted for perfect fit with said lacing and easily removed from the foot with said zip-fastener. For further improving the comfort and fit of the shoe, the shoe may be provided with a detachable, exchangeable innersole being molded to fit the outer sole. The innersole may preferably exhibit an intermediate layer in the treading part and the heel part of the sole, said layer providing high friction abutment on the upper side of the outer sole as well as shock absorption.

These together with other objects and advantages, which will become apparent, reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
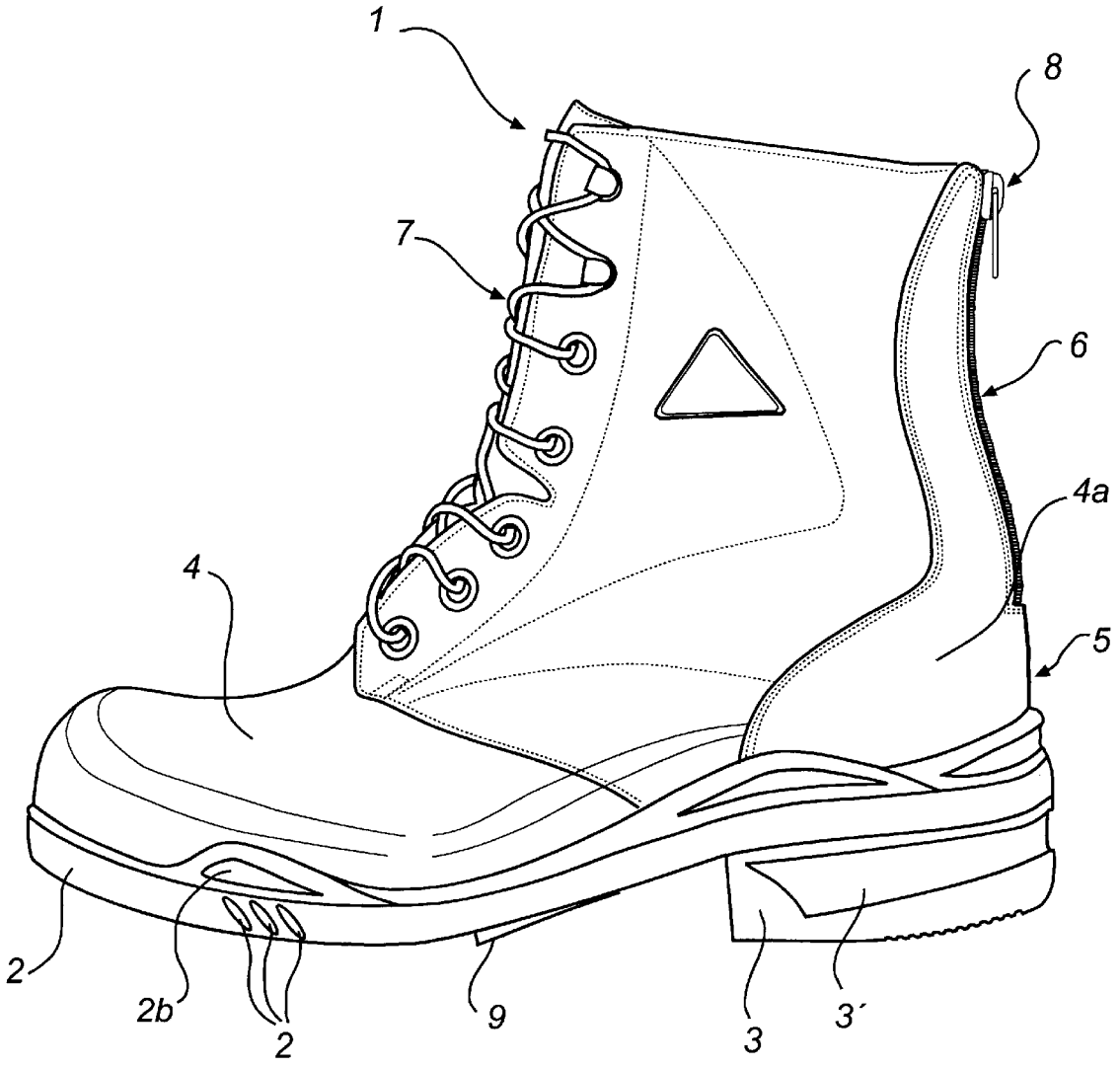
FIG. 1 is an outer side view of a riding shoe in accordance with the invention.
Figure 2:
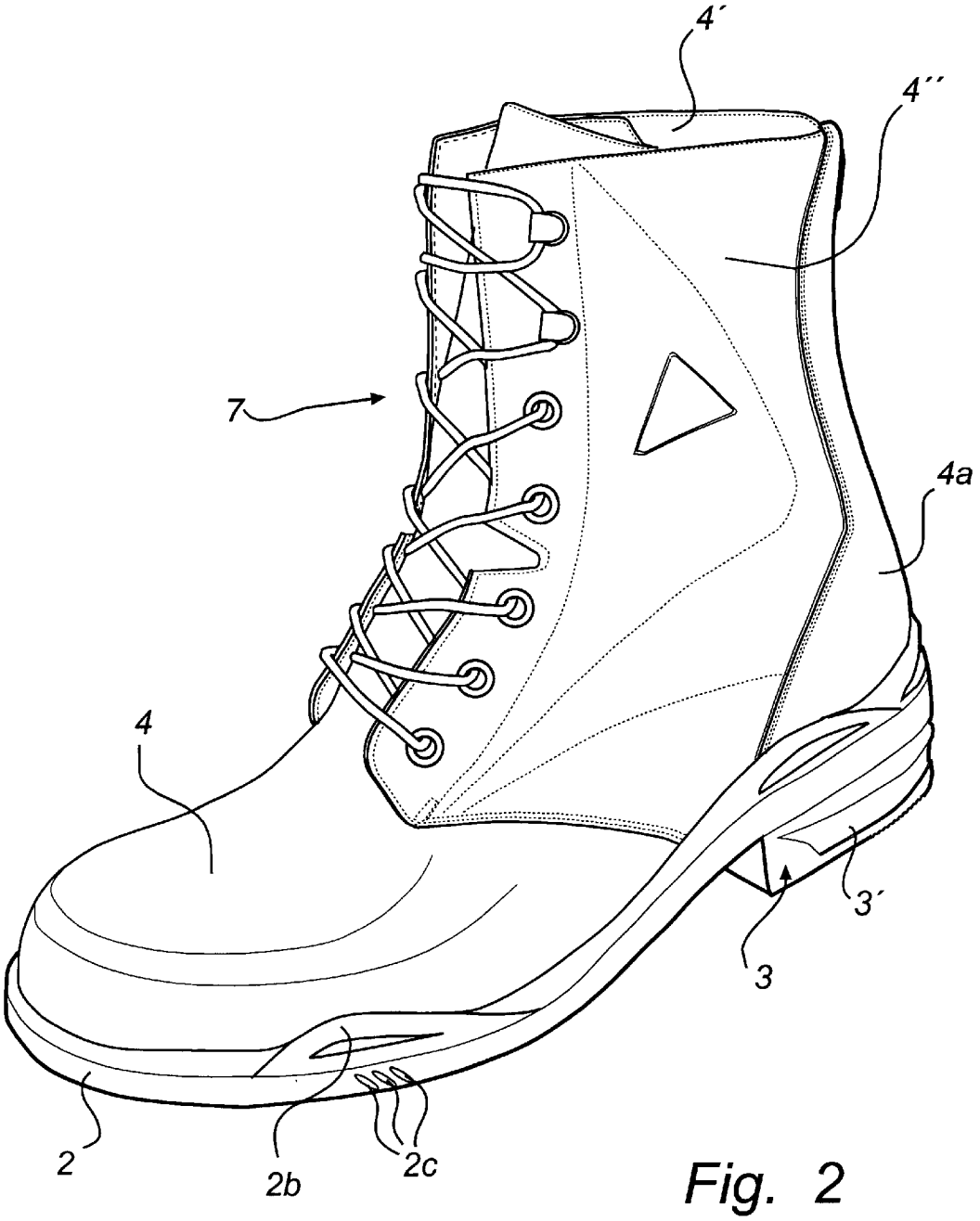
FIG. 2 is a front perspective view of the riding shoe of FIG. 1.
Figure 3:
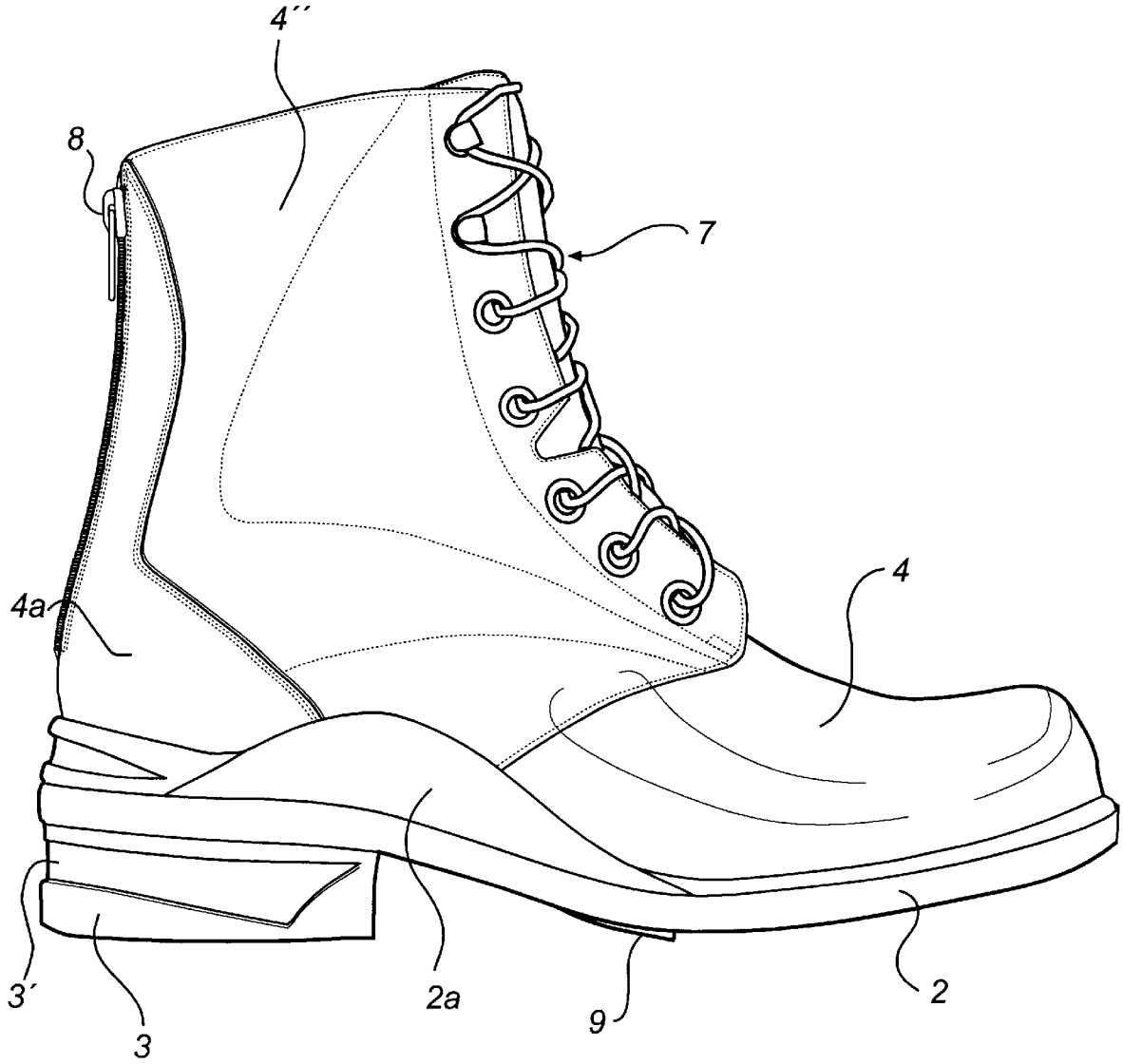
FIG. 3 is an inner side view of the riding shoe of FIG. 1.
Figure 4:
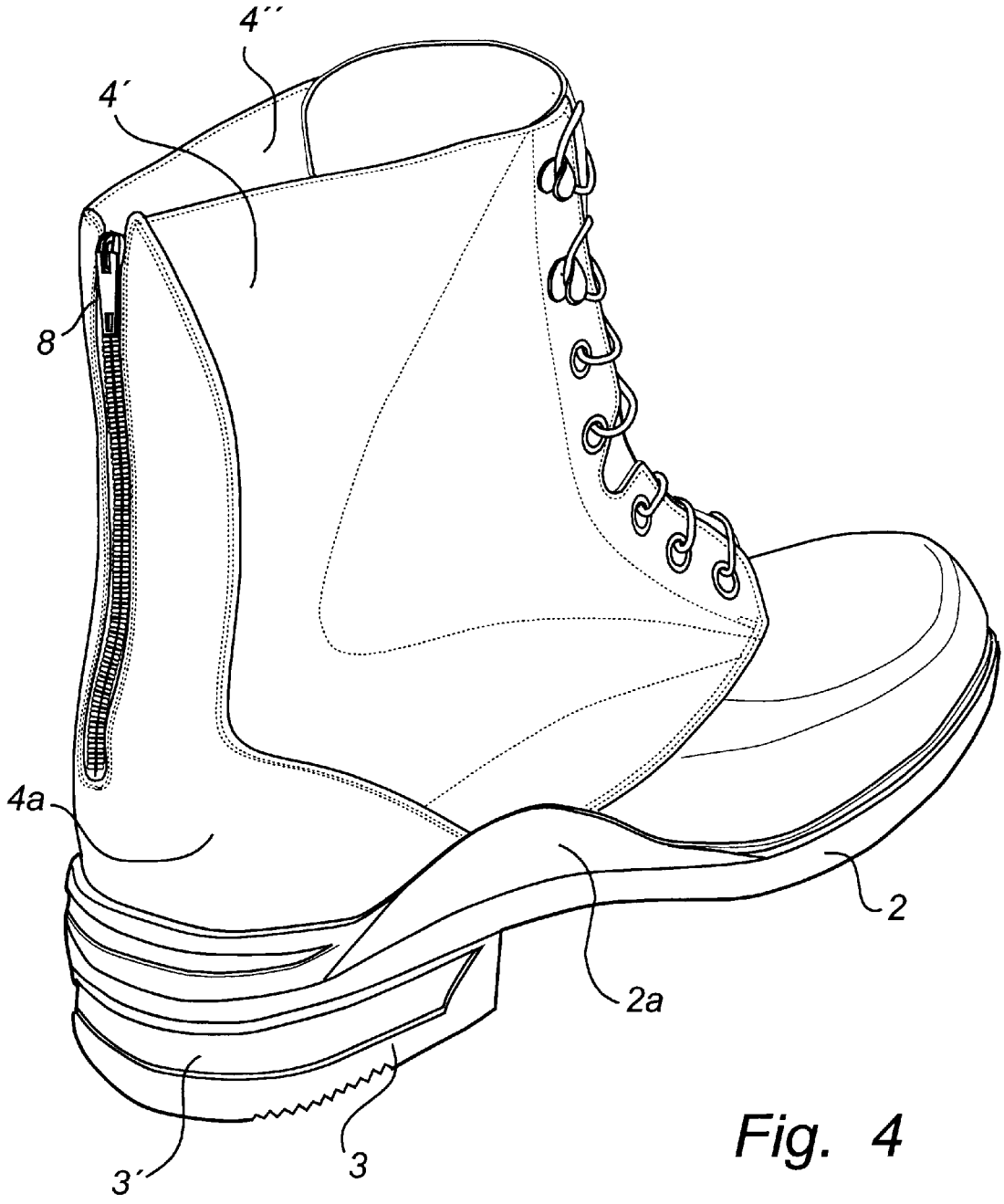
FIG. 4 is rear perspective view of the riding shoe of FIG. 1.
Figure 5:
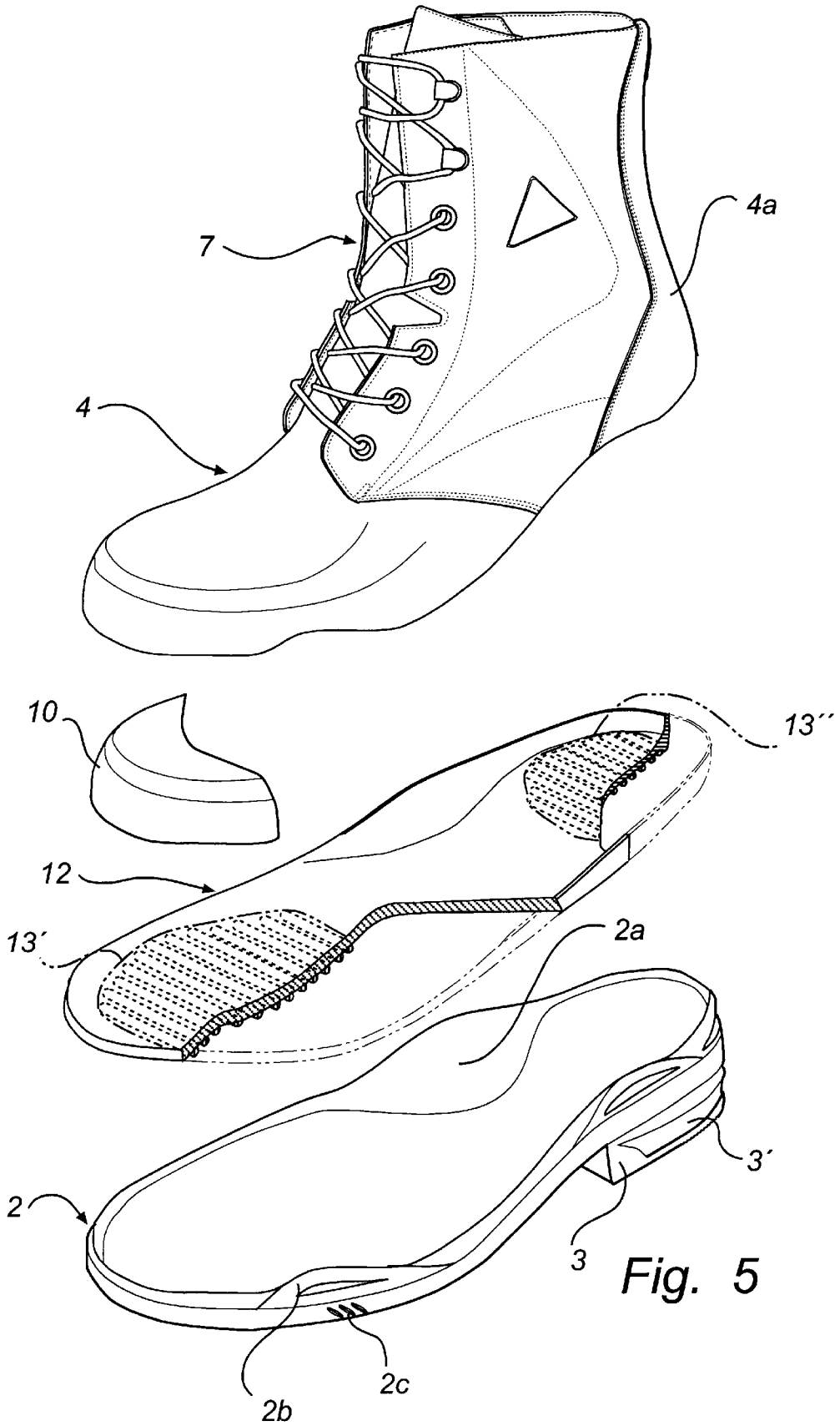
FIG. 5 is an exploited view of the riding shoe of FIG. 1.

Referring in detail to the drawings, a riding shoe 1 has a sole 2, a heel 3 and an upper 4 defining a foot portion 5 and an ankle portion 6, said upper 4 being of leather, fabric or the like. The ankle portion 6 of the upper 4 is mainly divided into an inner 4' and an outer 4" part defining a front and a back slit, said front slit being interconnected with a lacing 7 and said back slit being interconnected with a zipper 8. The sole 2 is molded to a shape aimed to support a foot. Said sole comprises an arch support 2*a* on the inner side of the sole 2 and a stirrup abutment area 2*b* on the outer fore side of the sole 2. This stirrup abutment area 2*b* serves to prevent a stirrup from sliding back as well as preventing wear of the upper 4 in this area. Right under the abutment area 2*b*, three oblique tracks 2*c* is provided, the angle of which is adapted to be in parallel with the outer stirrup bone, when using flexible stirrups with rotatable stirrup treads. These tracks 2*c* serves to prevent a stirrup from sliding back, into the middle area 2" of the sole 2. The tracks and the abutment area thus act as a stirrup stopping device. To further prevent this action, the side of the sole 2 facing the ground while walking is provided with a stopping edge 9, stopping the tread of the stirrup from sliding back into the middle area of the sole 2".

To further stabilize the foot in the shoe 1 the upper 4 is provided with heel enforcing parts 4*a*, giving the heel sidewise support. In the heel area the sole 2 is also essentially formed as bowl, in order to accomplish an excellent and stable fit for the heel. The shoe 1 is further equipped with a toe-cap 10, stabilizing the foot as well as offering protection against impact in the sensitive toe area of the foot.

Figure 6:
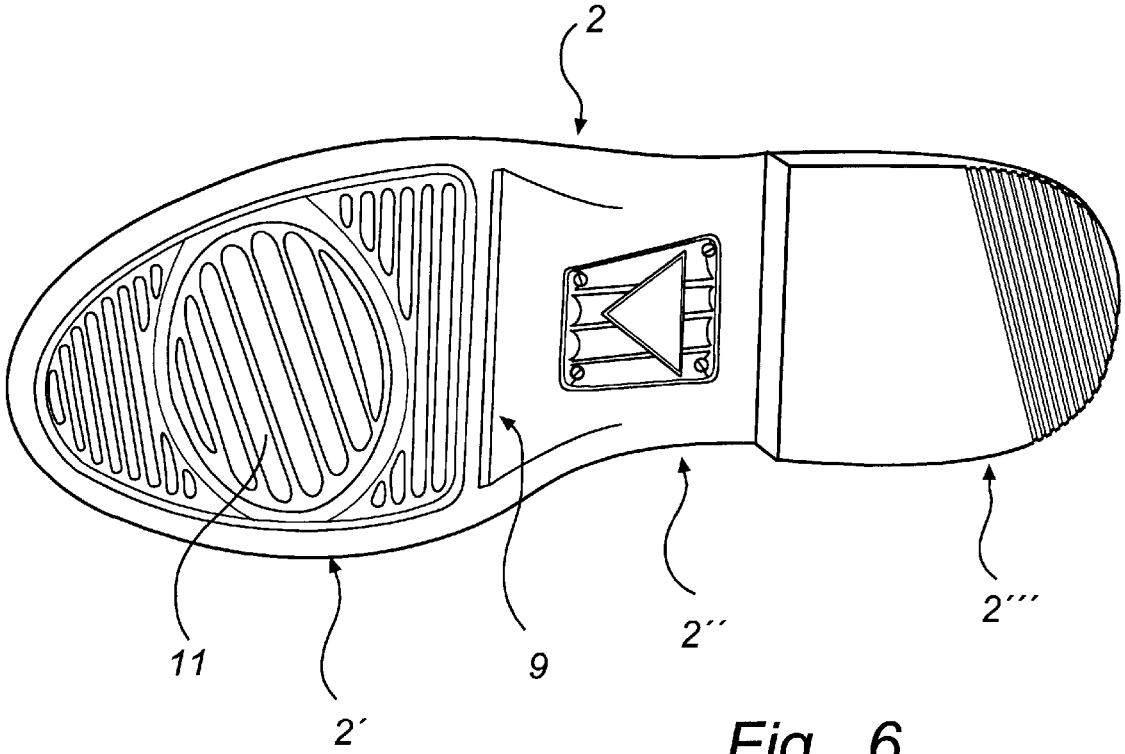
FIG. 6 is bottom view of the riding shoe of FIG. 1.
Figure 7:
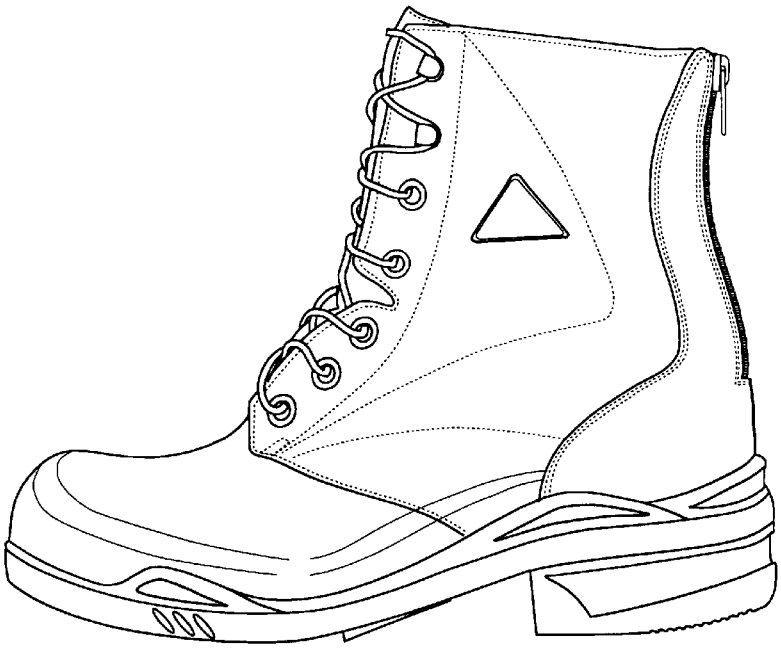
FIG. 7 is an outer side view of a riding shoe in accordance with the invention.
Figure 8:
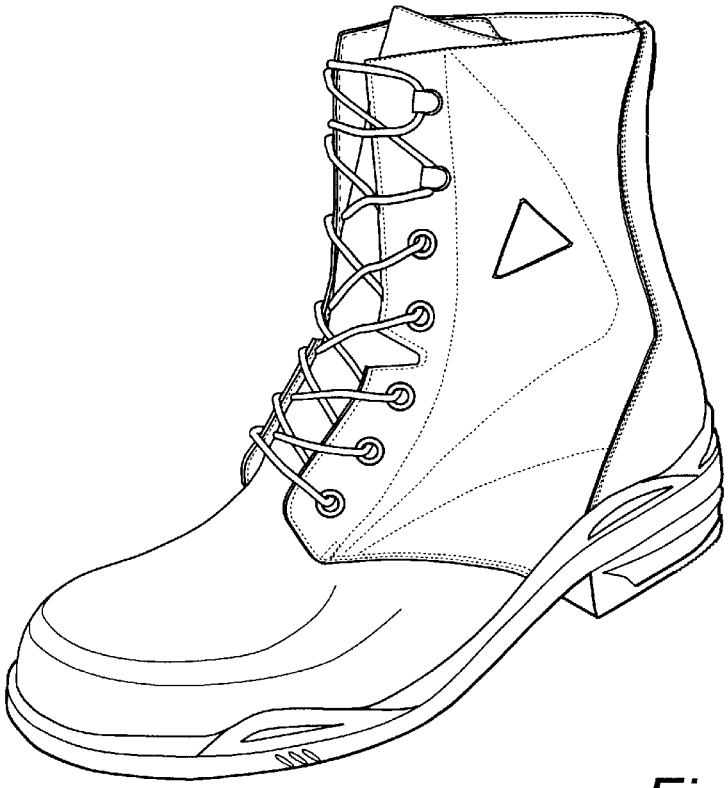
FIG. 8 is a front perspective view of the riding shoe of FIG. 7.
Figure 9:
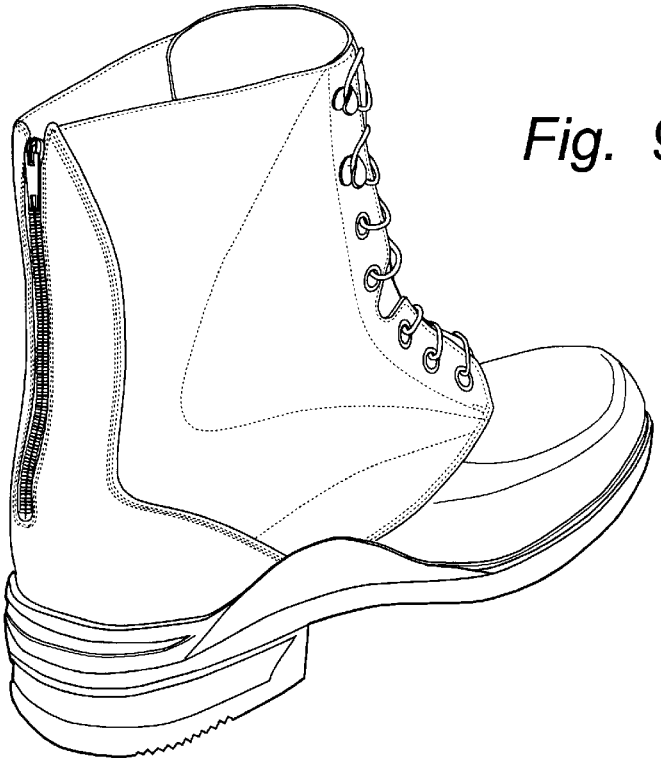
FIG. 9 is a rear perspective view of the riding shoe of FIG. 7.
Figure 11:
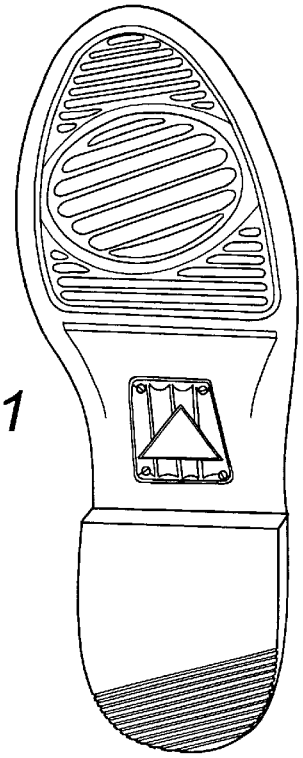
FIG. 11 is a bottom view of the riding shoe of FIG. 7.
Figure 10:
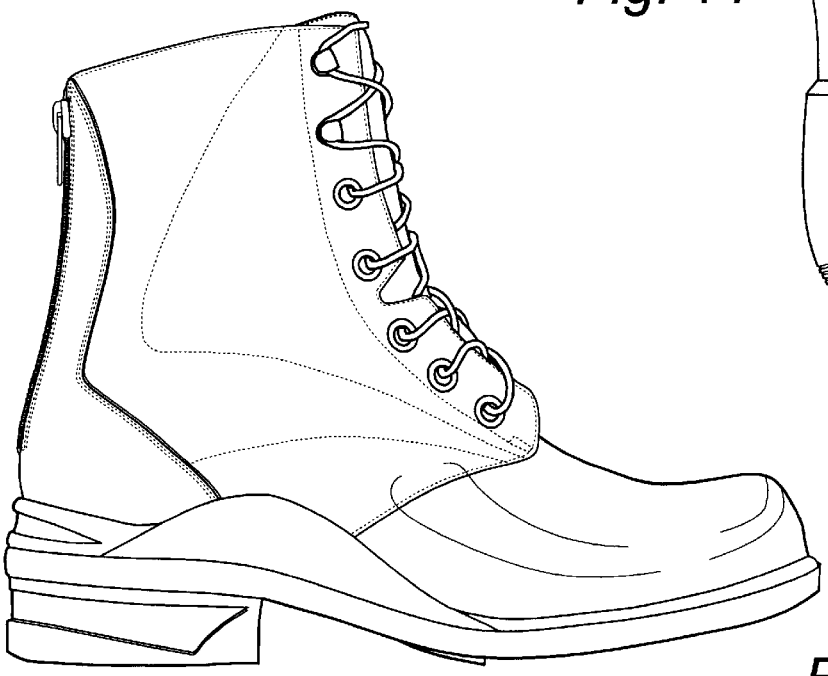
FIG. 10 is an inner side view of the riding shoe of FIG. 7.
Figure 12:
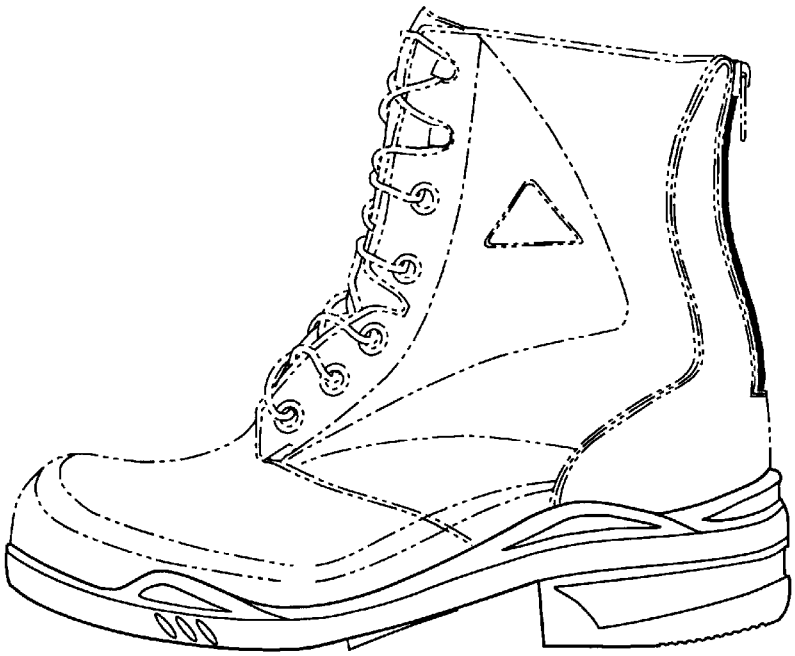
FIG. 12 is an outer side view of a sole of a riding shoe.
Figure 13:
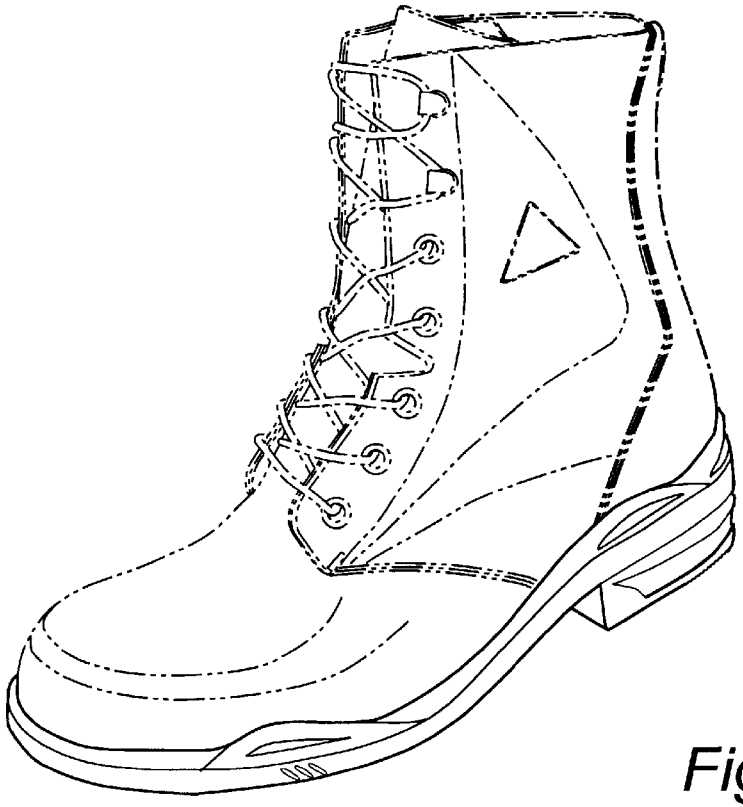
FIG. 13 is a front perspective view of the sole of FIG. 12.
Figure 14:
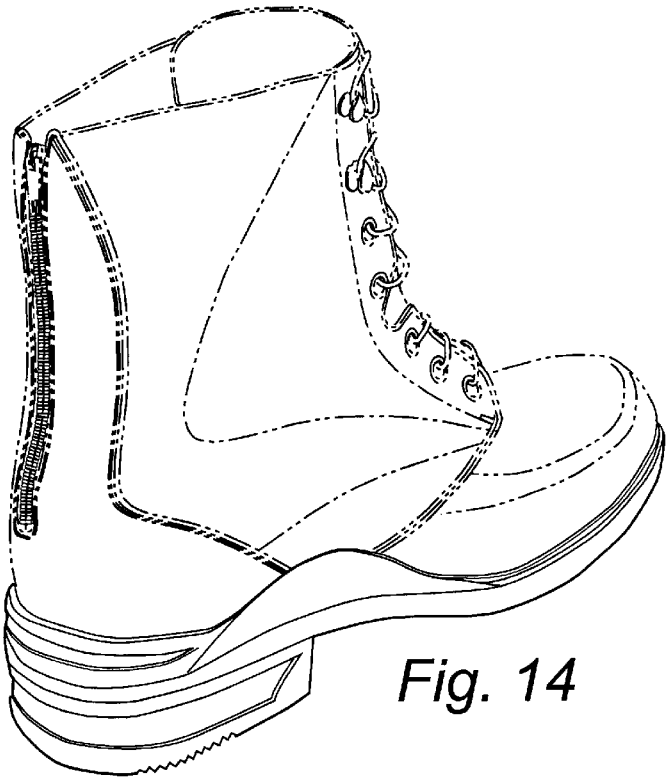
FIG. 14 is a rear perspective view of the sole of FIG. 12.
Figure 16:
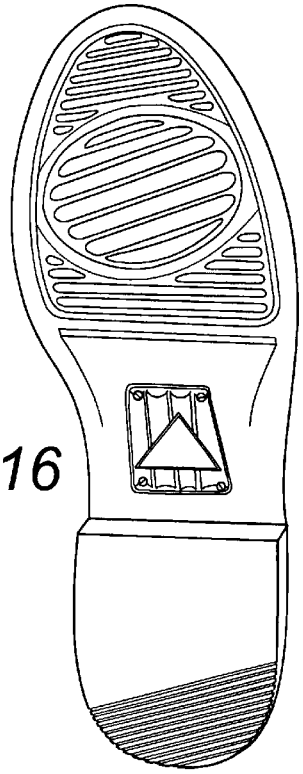
FIG. 16 is a bottom view of the sole of FIG. 12.
Figure 15:
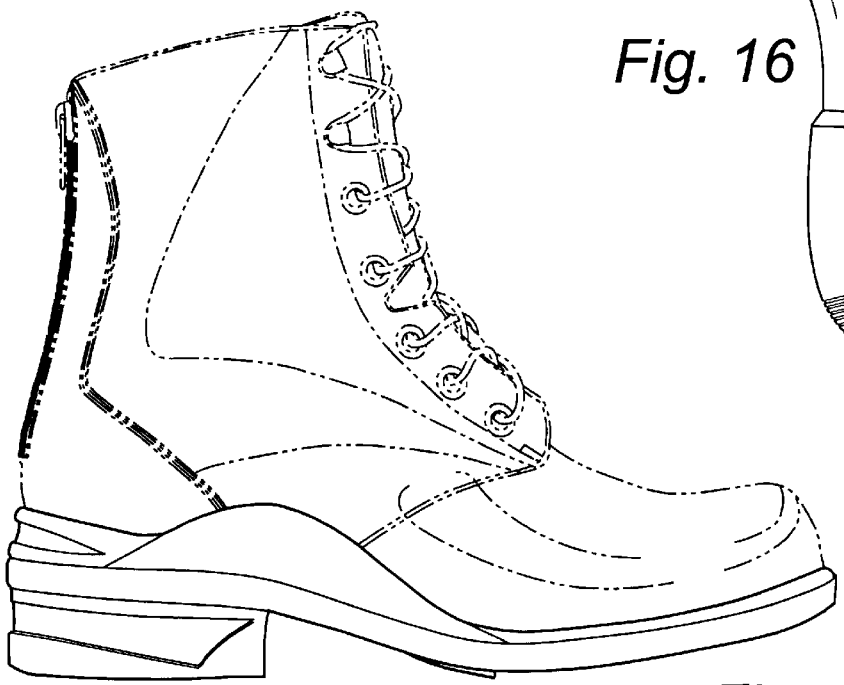
FIG. 15 is an inner side view of the sole of FIG. 12.
Figure 17:
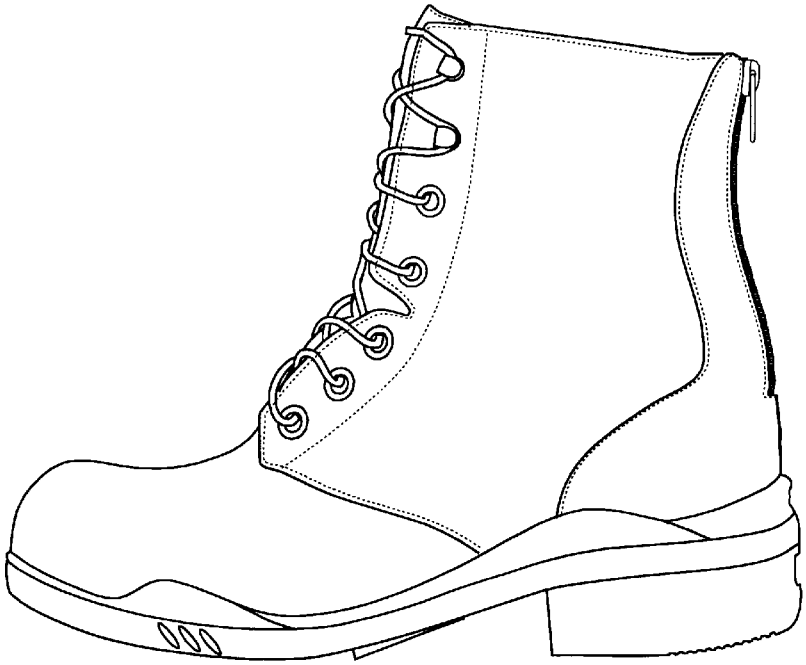
FIG. 17 is an outer side view of a riding shoe in accordance with the invention.
Figure 18:
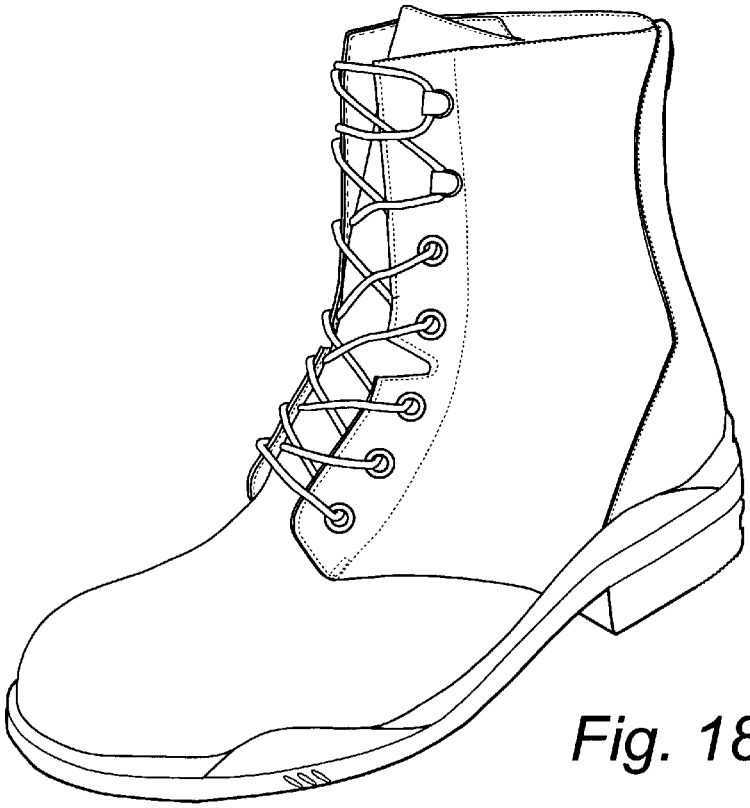
FIG. 18 is a front perspective view of the riding shoe of FIG. 17.
Figure 19:
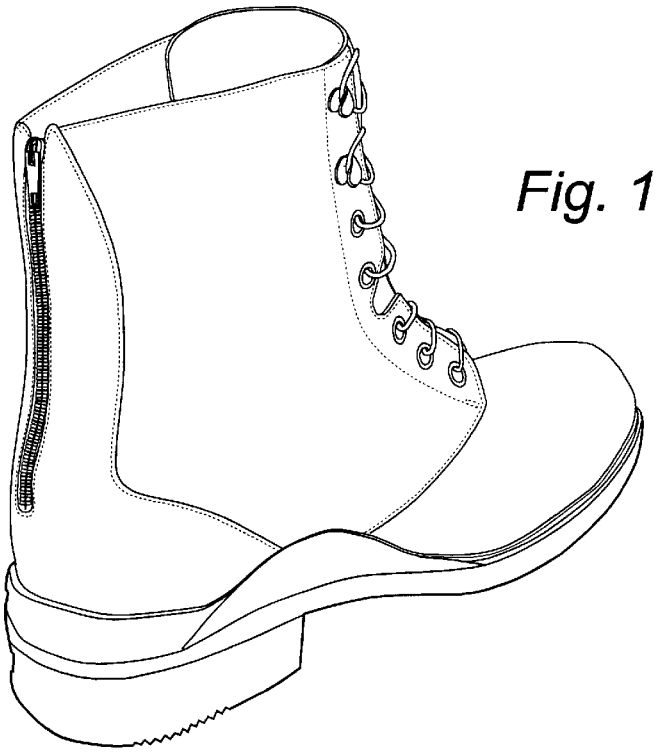
FIG. 19 is a rear perspective view of the riding shoe of FIG. 17.
Figure 21:
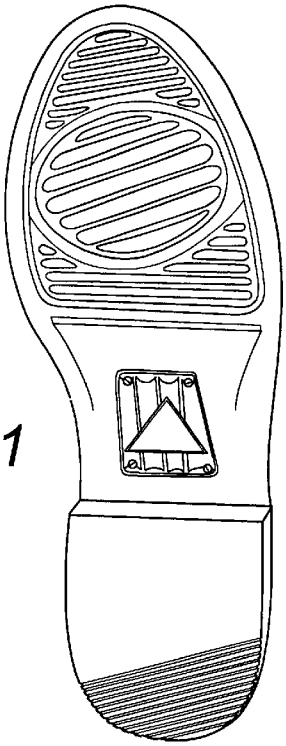
FIG. 21 is a bottom view of the riding shoe of FIG. 17.
Figure 20:
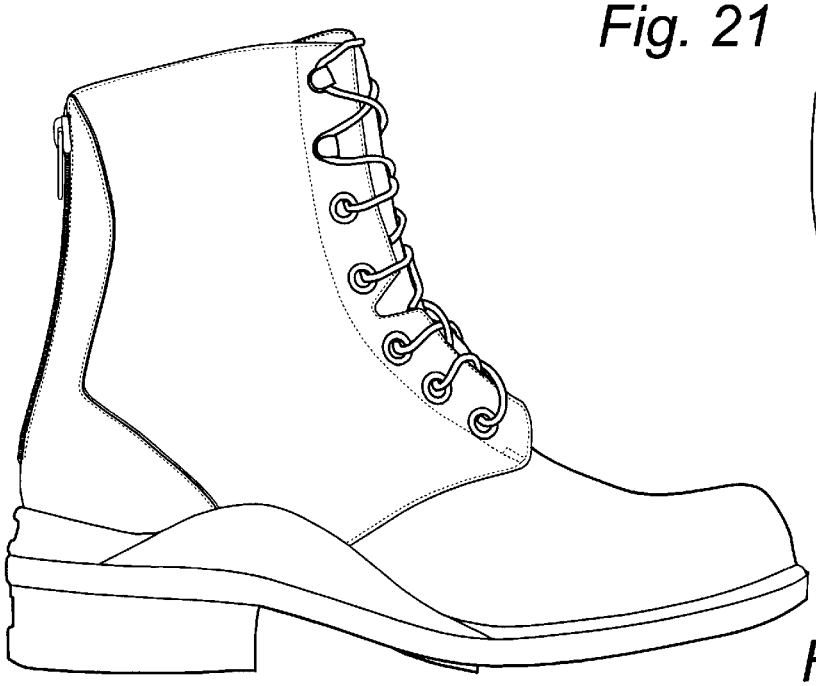
FIG. 20 is an inner side view of the riding shoe of FIG. 17.

The sole 2 may be divided into three parts for easy reference. The back part of the sole 2, here called the heel part 2'", is the part of the sole 2 where the heel 3 is mounted. The middle part 20 of the sole 2 is the part of the sole 2 that is not aimed to contact the ground when walking. The front part of the sole 2, called the treading part 2', is the part of the sole 2 aimed to be placed partly near and partly on a stirrup thread when riding. Here the treading part 2' exhibits a pattern with stripes, being formed in integration with the sole, see FIG. 6. In the central area of the treading part, the stripes extend in direction, from the inner side of the shoe forward towards the outer side of the shoe. The angle between those stripes 11 and the transverse direction of the shoe 1 is such that when riding, those stripes 11 are essentially parallel with the tread of the stirrup, offering a good grip between the tread and the sole 2.

Finally, the shoe 1 is provided with an inner sole 12, being removably and exchangably placed in the shoe. Said inner sole 12 is molded to fit the upper side of the outer sole 2. On the side of the inner sole 12 facing the outer sole 2, the inner sole 12 is provided with areas of cushioning and high friction material 12', 13", in this case in the areas abutting on the heel part 2'" and the treading part 2' of the outer sole 2. These areas prevent the inner sole 12 to slide in relation to the outer sole 2 and act as a shock absorber when walking.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A riding shoe comprising:

a sole including a toe portion, a middle portion and a heel portion, a heel extending from the heel portion comprising a built up area having a predetermined height so as to raise the middle portion of the sole out of contact with a ground surface, and an upper defining a foot-receiving portion and an ankle-receiving portion, wherein the shoe has a pronation support system comprising an arch support integrated with said sole, said arch support being defined by an upwardly extending member generally configured to conform to an arch of a wearer, wherein a stirrup stopping device is provided on an outer side of the shoe, in an area between the sole and the upper, and wherein said stirrup stopping device comprises at least one track being provided on the sole on the outer side of the shoe, which track extends from the lower side of the sole, in a forward direction to the upper part or the sole.

2. A riding shoe of claim 1 wherein said pronation support system further comprises a reinforced heel section of the upper for supporting the foot in a proper position.

3. A riding shoe of claim 1 wherein said pronation support system further comprises a toe-cap for supporting the foot in a proper position.

4. A riding shoe of claim 1 wherein said pronation support system further comprises a cup-shaped heel section integrated with said sole, for supporting the foot in a proper position.

5. A riding shoe of claim 1 wherein said upper has a lengthwise opening being held together with a lacing.

6. A riding shoe of claim 1 wherein said upper has a lengthwise opening being held together with a zip-fastener.

7. A riding shoe of claim 1 wherein said upper has only two lengthwise openings, a first one being held together with a lacing, and a second one being held together with a zip-fastener.

8. A riding shoe of claim 1 wherein said toe portion includes a treading part, said treading part of the sole having a striped pattern, at least partly exhibiting stripes extending from an outer side of the sole, backwards to an inner side of the sole.

9. A riding shoe of claim 1 wherein said middle portion includes only one stopping edge facing the ground surface, said stopping edge projecting downward from the middle part of the sole toward the ground surface such that said stopping edge prevents movement of a stirrup sliding backward along a bottom surface of the sole toward the heel portion when said riding shoe is used by a wearer.

10. A riding shoe of claim 1 wherein said stirrup stopping device is an integrated part of the sole, extending upwards in relation to the sole, into the area of the upper.

11. A riding shoe of claim 1 wherein said shoe has a total height of about 10–20 inches.

12. A riding shoe of claim 1 wherein said shoe has a detachable, exchangeable inner sole being molded to fit an outer sole.

13. A riding shoe of claim 12 wherein said inner sole at least in the area of the heel part and the threading part exhibits an intermediate layer providing a high friction abutment against the outer sole as well as shock absorption.

14. A riding shoe for maintaining stirrup position, said shoe comprising a sole, a heel, and an upper defining a foot-receiving portion and an ankle-receiving portion, wherein a stirrup stopping device is provided on an outer lateral side of the shoe, said stopping device comprising at least two tracks each having an elongate shape extending from a lower region of the lateral side of the sole generally adjacent an outsole, in a forward direction to an upper region of the lateral side of the sole so as to define a track angle, and said at least two tracks being disposed so as to prevent rearward stirrup movement.

15. A riding shoe of claim 14, wherein said stirrup stopping device further comprises a sole extension being provided above said tracks.

16. A riding shoe of claim 14 wherein an abutment is provided on the sole, between a treading part and a middle part of the sole, for preventing a stirrup to slide back to the middle part while horse riding.

17. A riding shoe of claim 14 wherein said sole comprises a treading part, a middle part and a heel part, said treading part of the sole having a striped pattern, at least partly exhibiting stripes extending from an outer side of the sole, backwards to an inner side of the sole.

18. A riding shoe of claim 14 wherein each of said at least two tracks is defined by unitary stop element.

19. A riding shoe of claim 14 wherein the track angle of said at least two tracks is adapted to be generally parallel with an outer stirrup bone of a stirrup when said riding shoe is used by a wearer.

* * * * *